US008505159B2

(12) United States Patent
Streciwilk

(10) Patent No.: US 8,505,159 B2
(45) Date of Patent: Aug. 13, 2013

(54) AGITATOR CAVITY FITTING FOR FLOOR CARE CLEANING APPARATUS

(75) Inventor: Eric J. Streciwilk, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 3001 days.

(21) Appl. No.: 10/806,499

(22) Filed: Mar. 23, 2004

(65) Prior Publication Data

US 2004/0211023 A1 Oct. 28, 2004

Related U.S. Application Data

(60) Provisional application No. 60/465,750, filed on Apr. 25, 2003.

(51) Int. Cl.

| | |
|---|---|
| ***A47L 9/10*** | (2006.01) |
| ***A47L 9/20*** | (2006.01) |
| ***A47L 9/22*** | (2006.01) |
| ***A47L 9/28*** | (2006.01) |
| ***A47L 11/00*** | (2006.01) |
| ***A47L 13/00*** | (2006.01) |
| ***A63B 47/04*** | (2006.01) |
| ***A63D 5/10*** | (2006.01) |
| *A47L 5/30* | (2006.01) |

(52) U.S. Cl.
USPC ..... 15/351; 15/412

(58) Field of Classification Search
USPC ..... 15/350–353, 377, 383, 384, 412
See application file for complete search history.

(56) References Cited

U.S. PATENT DOCUMENTS

| | | | | |
|---|---|---|---|---|
| 1,347,166 | A | 7/1920 | Kirby | |
| 3,936,905 | A | 2/1976 | Stewart et al. | |
| 3,942,216 | A | 3/1976 | Minton | |
| 4,023,234 | A | 5/1977 | Martinec et al. | |
| 4,198,727 | A | 4/1980 | Farmer | |
| 4,219,902 | A | 9/1980 | DeMaagd | |
| RE31,095 | E * | 12/1982 | Tschudy | 15/383 |
| 4,426,751 | A | 1/1984 | Nordeen | |
| 5,513,418 | A * | 5/1996 | Weber | 15/383 |
| 6,006,402 | A | 12/1999 | Maurer et al. | |
| 6,039,817 | A | 3/2000 | Payne | |
| 6,052,866 | A | 4/2000 | Tuvin et al. | |
| 6,148,474 | A * | 11/2000 | Ohara et al. | 15/377 |
| 6,226,832 | B1 * | 5/2001 | McCormick | 15/391 |
| 6,237,189 | B1 | 5/2001 | Maurer et al. | |
| 6,289,552 | B1 * | 9/2001 | McCormick | 15/324 |
| 7,181,804 | B2 * | 2/2007 | Hafling et al. | 15/347 |
| 2002/0104185 | A1 * | 8/2002 | Weber et al. | 15/383 |
| 2002/0129460 | A1 * | 9/2002 | Roney et al. | 15/351 |
| 2003/0188396 | A1 | 10/2003 | Hitzelberger | |

OTHER PUBLICATIONS

U.S. Appl. No. 10/788,809, filed on Feb. 27, 2004; entitled Nozzle Assembly With Edge Cleaning Through Agitator Cavity.

* cited by examiner

*Primary Examiner* — Joseph J Hail
*Assistant Examiner* — Alvin Grant
(74) *Attorney, Agent, or Firm* — King & Schickli, PLLC

(57) ABSTRACT

A floor care cleaning apparatus includes a nozzle assembly including a housing defining an agitator cavity. A canister assembly is connected to the nozzle assembly. A suction generator is carried by either the nozzle assembly or the canister assembly. A dirt collection vessel is also carried by one of these assemblies. In addition, an agitator cavity fitting is carried by the nozzle assembly. The agitator cavity fitting includes a cooperating air guide and conduit. The conduit defines an intake port of the floor cleaning apparatus.

8 Claims, 3 Drawing Sheets

AGITATOR CAVITY FITTING FOR FLOOR CARE CLEANING APPARATUS

This application claims the benefit of U.S. Provisional Patent Application Ser. No. 60/465,750 filed on Apr. 25, 2003.

TECHNICAL FIELD

The present invention relates generally to the floor care equipment field and, more particularly, to an agitator cavity fitting and to a floor care cleaning apparatus incorporating that agitator cavity fitting.

BACKGROUND OF THE INVENTION

Floor care cleaning equipment such as canister vacuum cleaners and upright vacuum cleaners have long been known in the art. Such vacuum cleaners usually incorporate a nozzle assembly having a rotary agitator to beat and brush dirt and debris from the nap of a carpet or rug being cleaned. The vacuum cleaners also include either a bag-like filter or a cyclonic separation chamber and filter combination that trap dirt and debris while substantially clean air is exhausted by an electrically operated fan that is driven by an onboard motor. It is this fan and motor arrangement that generates the drop in air pressure necessary to provide the desired cleaning action.

The present invention relates to an agitator cavity fitting that provides a simple, inexpensive means for connecting an airflow conduit to the agitator cavity so as to allow dirt and debris to be efficiently drawn into the dirt collection vessel.

SUMMARY OF THE INVENTION

In accordance with the purposes of the present invention as described herein, a floor care cleaning apparatus is provided. That apparatus includes a nozzle assembly having a housing defining an agitator cavity. The apparatus also includes a canister assembly connected to the nozzle assembly. Both a suction generator and a dirt collection vessel are carried by one of the nozzle assembly and the canister assembly. Additionally, an agitator cavity fitting is carried by the nozzle assembly. The agitator cavity fitting includes a cooperating air guide and conduit. The conduit defines an intake port.

More particularly describing the invention, the agitator cavity fitting further includes means for mounting the agitator cavity fitting to the nozzle assembly. That means for mounting may comprise, for example, at least one mounting lug and at least one T-shaped connector. Of course, any other appropriate fastening structure known in the art to be useful for that intended purpose may be utilized.

The housing of the agitator cavity includes at least one receiver receiving the at least one mounting lug and at least one slot receiving the at least one T-shaped connector in order to provide for secure connection of the fitting to the housing.

In addition, the housing includes a channel receiving the air guide and an opening receiving the conduit. Accordingly, the air guide partially lines the agitator cavity. In contrast, the conduit projects outwardly from the agitator cavity and has an open end that engages a hose or other conduit providing fluid communication between the agitator cavity and the dirt collection vessel.

In accordance with yet another aspect of the present invention the agitator cavity fitting, as described above, is claimed as an individual component.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings.

Reference will now be made in detail to the present preferred embodiment of the invention, an example of which is illustrated in the accompanying drawing.

DETAILED DESCRIPTION OF THE INVENTION

Figure 1:
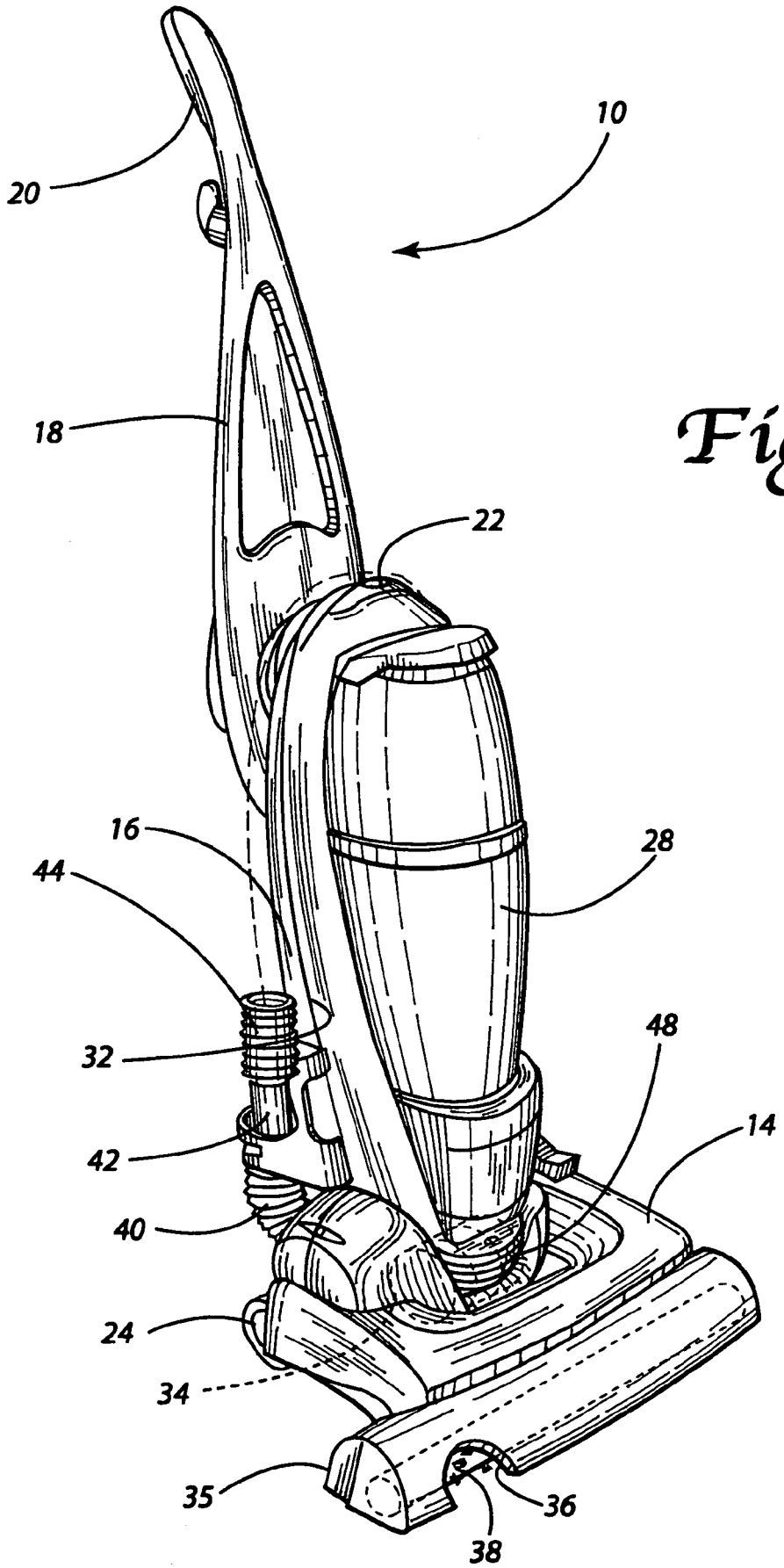
FIG. 1 is a perspective view of an upright vacuum cleaner equipped with the agitator cavity fitting of the present invention.

Reference is now made to FIG. 1 showing an upright vacuum cleaner 10 equipped with the agitator cavity fitting 12 of the present invention. The upright vacuum cleaner 10 includes a nozzle assembly 14 and a handle or canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet, battery, fuel cell or other power source through a cord (not shown).

A pair of rear wheels 24 (only one shown in the drawing figure) are provided on the lower portion of the canister assembly 16 and a pair of front wheels (not shown) are provided on the nozzle assembly 14. Together, these wheels 24 support the vacuum cleaner 10 for movement across the floor. To allow for convenient storage of the vacuum cleaner 10, a foot latch (not shown) functions to lock the canister assembly 16 in an upright position as shown in FIG. 1. When the foot latch is released, the canister assembly 16 may be pivoted relative to the nozzle assembly 14 as the vacuum cleaner is manipulated to-and-fro to clean the floor.

The canister assembly 16 includes a cavity 32 adapted to receive and hold a dirt collection vessel 28. As illustrated, the dirt collection vessel 28 is a removable dirt cup. Alternatively, it should be appreciated that the dirt collection vessel could be a filter bag of a type known in the art.

The canister assembly 16 also carries a suction generator 34 consisting of a cooperating fan and drive motor that function to generate a vacuum airstream for drawing dirt and debris from the surface to be cleaned. While the suction generator 34 is illustrated as being carried on the canister assembly 16, it should be appreciated that it could likewise be carried on the nozzle assembly 14 if desired.

Figures 2, 3:
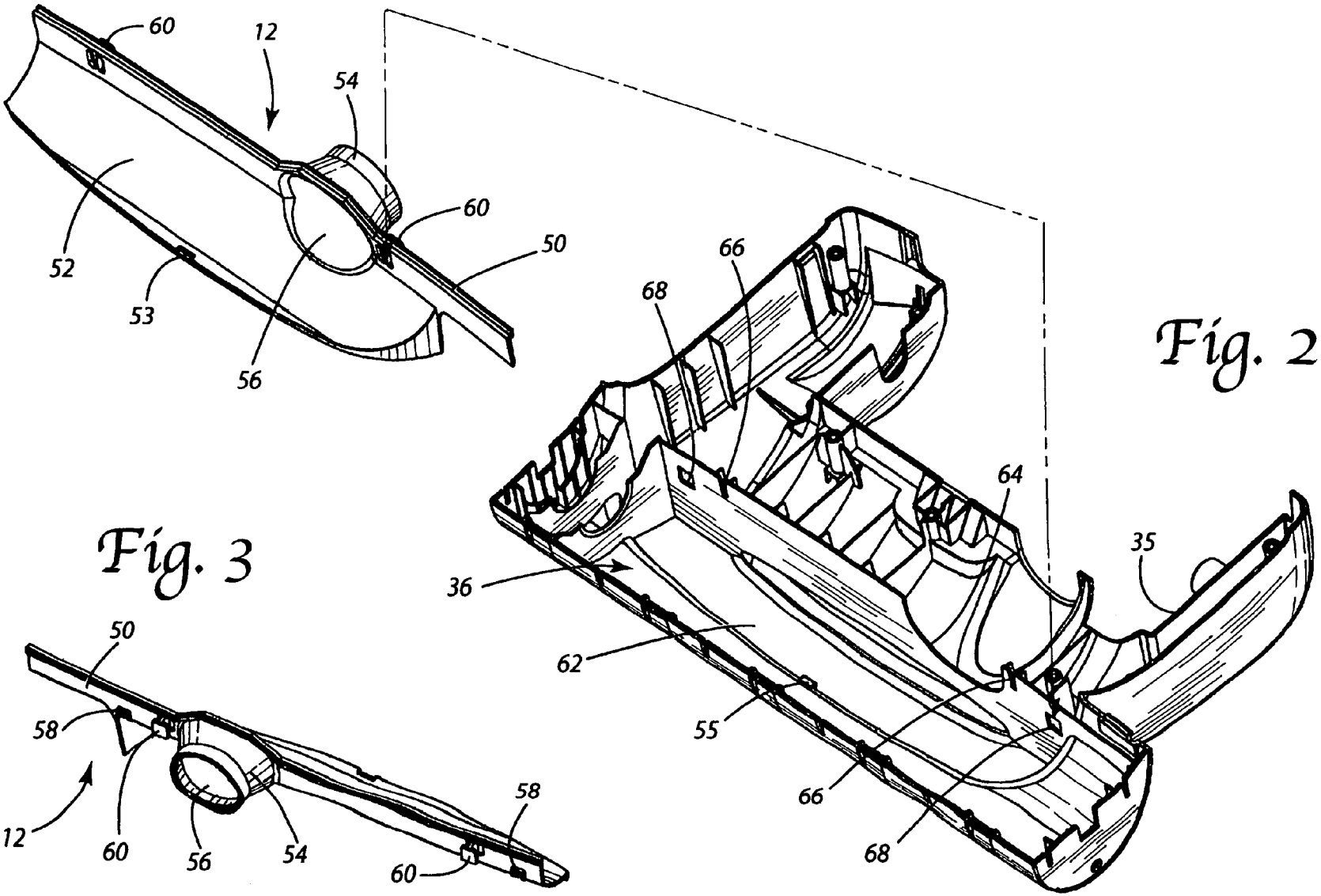
FIG. 2 is a detailed, exploded perspective view illustrating the housing of a nozzle assembly and the agitator cavity fitting.
FIG. 3 is a detailed perspective view of the agitator cavity fitting illustrating the cooperating connectors and lugs utilized to mount the fitting to the nozzle assembly housing.
Figure 4:
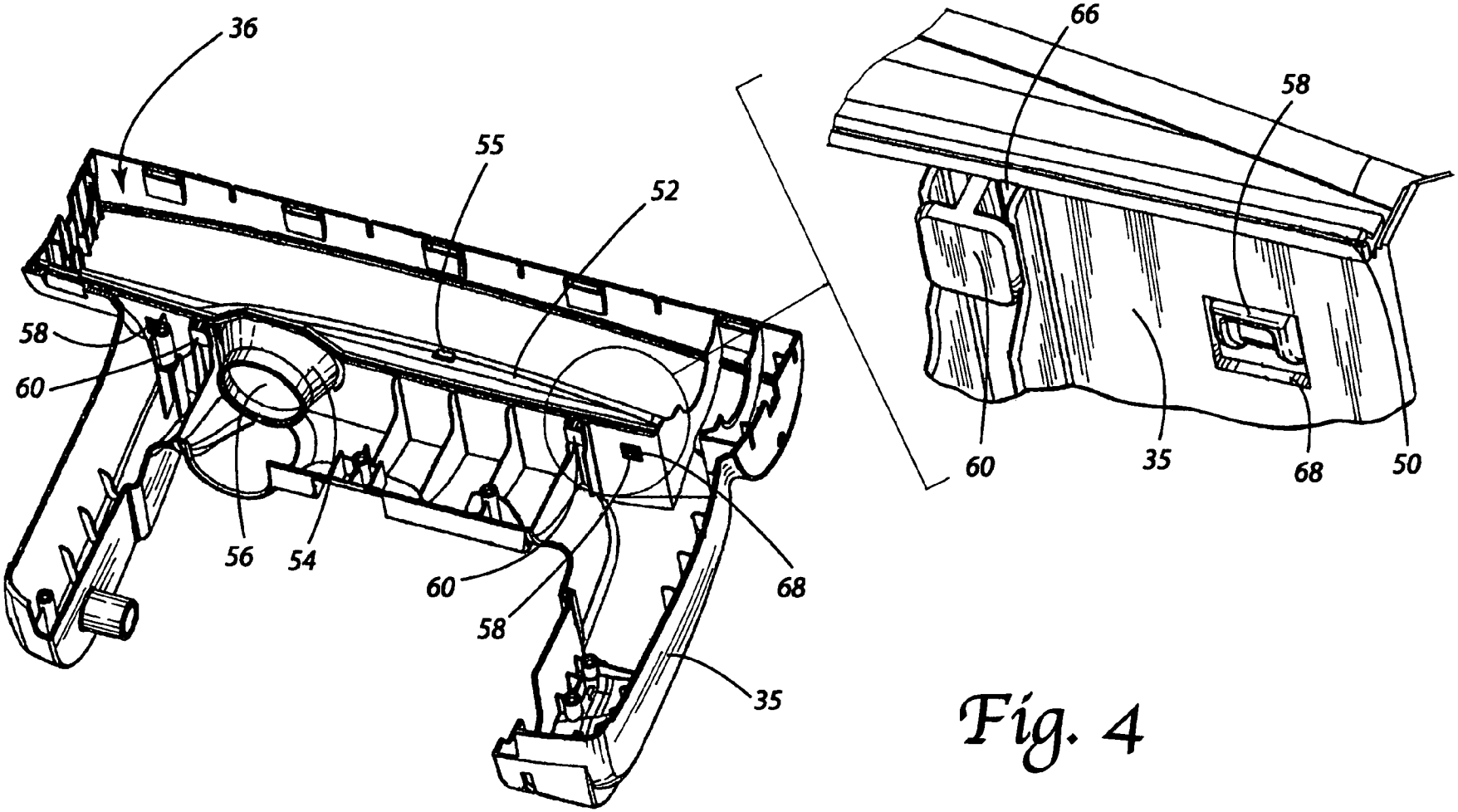
FIG. 4 illustrates the agitator cavity fitting mounted in the housing.

The nozzle assembly 14 includes a housing 35 defining a nozzle and agitator cavity 36 that houses at least one rotating agitator brush 38 (see also FIGS. 2 and 3). The agitator brush 38 is rotatably driven by the motor of the suction generator 34 by means of a power transmission of a type known in the art. That transmission may incorporate belts and pulleys, meshing gears or both.

The scrubbing action of the rotary agitator brush 38 and the negative air pressure created by the suction generator 34 cooperate to brush and beat dirt and debris from the nap of the carpet being cleaned and then draw the dirt and dust laden air from the agitator cavity 36 to the dirt collection vessel 28. Specifically, the dirt and dust laden air passes serially from the agitator cavity 36 through the flexible hose 40, the wand conduit 42, a second flexible hose 44 to an inlet port (not shown). The inlet port is connected to an internal delivery conduit (not shown) that delivers air through the canister assembly 16 into the dirt collection vessel 28. The dirt collection vessel 28 serves to trap the suspended dirt, dust and other particles inside while allowing the now clean air to pass freely through to the suction generator 34 where that air passes over the motor of the generator to provide cooling before being exhausted through a final filtration cartridge (not shown) and ultimately to the environment through the exhaust port 48.

As illustrated in FIGS. 2 and 3, the agitator cavity fitting 12 comprises a body 50 that may be generally described as including a cooperating air guide 52 and conduit 54. The conduit 54 defines an intake port 56. As further illustrated, the agitator cavity fitting 12 includes at least one mounting lug 58 (two are illustrated) and at least one T-shaped connector 60 (again, two are illustrated).

The agitator cavity fitting 12 is mounted to the housing 35 of the nozzle assembly 14 so that the air guide 52 actually lines a portion of the agitator cavity 36. More specifically, the air guide 52 is received in a channel 62 formed or molded in the housing 35 so that the notch 53 along the edge of the air guide 52 is positioned under the tab 55 on the housing 35. Simultaneously, the projecting end of the conduit 54 extends through an opening 64 formed in the housing 35 and the T-shaped connectors 60 slide into cooperating slots 66 formed in the housing 35. Once the agitator cavity fitting 12 is fully and properly seated in the agitator cavity 36 of the housing 35, the mounting lugs 58 engage in cooperating apertures 68 formed in the housing 35. Once seated in position the end of the flexible hose 40 is secured on the projecting end of the conduit 54 by friction fit, threaded connection or any other appropriate means known to those skilled in the art in order to provide fluid communication between the agitator cavity 36, the conduit 54 of the agitator cavity fitting 12, the flexible hose 40, the wand conduit 42, the second flexible hose 44, the inlet port, the internal delivery conduit and the dirt collection vessel 28.

Advantageously, the agitator cavity fitting 12 of the present invention comprises a cooperating air guide 52 and conduit 54 that provide for clean smooth air flow as air entrained with dirt and debris moves from the agitator cavity into the flexible hose 40. This promotes improved cleaning efficiency.

Additionally, it should be appreciated that the agitator cavity fitting 12 is relatively inexpensive to produce since it may be molded from relatively inexpensive plastic materials in a simple mold. It is far less expensive to mold and install the single piece agitator cavity fitting 12 in the housing 35 of the nozzle assembly 14 than to attempt to mold a hose or conduit fitting as an integral part of the housing 35. Accordingly, design is simplified and mold design and manufacturing costs are significantly reduced. Further, it should be appreciated that the conduit 54 provides a structure that will readily receive substantially any type of conduit to allow fluid communication from that conduit through the intake port 56 to the agitator cavity 36.

The foregoing description of the preferred embodiment of the invention has been presented for purposes of illustration and description. It is not intended to be exhaustive or to limit the invention to the precise form disclosed. Obvious modifications or variations are possible in light of the above teachings.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

The invention claimed is:

1. A floor care cleaning apparatus, comprising:

a nozzle assembly including a housing defining an agitator cavity;

a canister assembly connected to said nozzle assembly;

a suction generator carried by one of said nozzle assembly and said canister assembly;

a dirt collection vessel carried by one of said nozzle assembly and said canister assembly; and an agitator cavity fitting received in said agitator cavity of said nozzle assembly, said agitator cavity fitting including, at least one mounting lug, at least one connector, a cooperating air guide and a conduit, said conduit defining an intake port:

said housing being further characterized by including at least one receiver receiving said at least one mounting lug, at least one slot receiving said at least one connector and a channel for receiving said air guide.

2. The floor care cleaning apparatus of claim 1, wherein said at least one receiver comprises at least one aperture receiving said at least one mounting lug.

3. The floor care cleaning apparatus of claim 1, wherein said housing also includes an opening receiving said conduit.

4. The floor care cleaning apparatus of claim 3, wherein said air guide partially lines said agitator cavity.

5. A floor care cleaning apparatus comprising:

a housing including an agitator cavity;

a suction generator;

a dirt collection vessel; and an agitator cavity fitting received in said agitator cavity of said housing, said agitator cavity fitting including at least one mounting connector, at least one mounting lug, a cooperating air guide and a conduit, said conduit defining an intake port:

said housing further including at least one receiver receiving said at least one mounting lug, at least one slot receiving said at least one connector and a channel receiving said air guide.

6. The floor care cleaning apparatus of claim 5, wherein said housing also includes an opening receiving said conduit.

7. The floor care cleaning apparatus of claim 6, wherein said air guide partially lines said agitator cavity.

8. The floor care cleaning apparatus of claim 7, wherein a tab is carried on said housing and a notch is carried on said agitator cavity fitting, said tab engaging said notch.

* * * * *